US011207898B2

(12) United States Patent
Murray

(10) Patent No.: US 11,207,898 B2
(45) Date of Patent: Dec. 28, 2021

(54) PRINT BAR STRUCTURE, A PRINTING APPARATUS, AND A METHOD OF PRINTING

(71) Applicant: PAILPRINT (PTY) LTD, Durban (ZA)

(72) Inventor: Brian Murray, Durban (ZA)

(73) Assignee: Pailprint (Pty) Ltd, Durban (ZA)

( * ) Notice: Subject to any disclaimer, the term of this patent is extended or adjusted under 35 U.S.C. 154(b) by 245 days.

(21) Appl. No.: 16/608,693

(22) PCT Filed: Apr. 26, 2018

(86) PCT No.: PCT/IB2018/052895

§ 371 (c)(1),
(2) Date: Oct. 25, 2019

(87) PCT Pub. No.: WO2018/198061

PCT Pub. Date: Nov. 1, 2018

(65) Prior Publication Data

US 2021/0276342 A1 Sep. 9, 2021

(30) Foreign Application Priority Data

Apr. 26, 2017 (ZA) ..... 2017/02909
Apr. 26, 2017 (ZA) ..... 2017/02910

(51) Int. Cl.
*B41J 3/407* (2006.01)
*B41J 3/54* (2006.01)
*B41J 2/145* (2006.01)

(52) U.S. Cl.
CPC ..... *B41J 3/40733* (2020.08); *B41J 2/145* (2013.01); *B41J 3/543* (2013.01)

(58) Field of Classification Search
CPC ..... B41J 3/40733; B41J 3/543; B41J 2/145
See application file for complete search history.

(56) References Cited

U.S. PATENT DOCUMENTS 8,753,026 B2 * 6/2014 Haan ..... B41J 11/46 400/76
9,604,450 B2 * 3/2017 Reder ..... B41J 2/21
(Continued)

FOREIGN PATENT DOCUMENTS

WO 2015/177599 A1 11/2015

OTHER PUBLICATIONS

International Search Report and Written Opinion from International Application No. PCT/IB2018/052895, dated Jul. 13, 2018.
(Continued)

*Primary Examiner* — Yaovi M Ameh
(74) *Attorney, Agent, or Firm* — Merchant & Gould P.C.

(57) ABSTRACT

This invention relates to a print bar structure, a printing apparatus and a method for printing on an outer surface of an object comprising at least one cylindrical portion, particularly a cylindrical and/or conical container. The invention also relates to a manufacturing facility and method for manufacturing containers. The printing apparatus typically comprises a print bar structure, a plurality of print heads attachable to the print bar structure, a curing device, and a displacement assembly operatively attachable to the container. The print bar structure at least partly defines a print zone, wherein the print heads and the curing device is operatively disposed in the print zone. The displacement assembly is operable to rotate object about an axis substantially aligned with the central axis relative to the plurality of print heads in the print zone such that fluid is deposited onto the object during rotation of the object.

20 Claims, 16 Drawing Sheets

(56) References Cited

U.S. PATENT DOCUMENTS

2010/0295885 A1* 11/2010 LaCaze ..... B41J 11/0021
347/8
2012/0274695 A1* 11/2012 LaCaze ..... B41J 29/02
347/16

OTHER PUBLICATIONS

International Preliminary Report on Patentability from International Application No. PCT/IB2018/052895, dated Apr. 15, 2019.

* cited by examiner

PRINT BAR STRUCTURE, A PRINTING APPARATUS, AND A METHOD OF PRINTING

This application is a National Stage Application of International Application No. PCT/IB2018/052895, filed Apr. 26, 2018, which claims benefit of Serial No. 2017/02910, filed Apr. 26, 2017 in South Africa and also claims benefit of Serial No. 2017/02909, filed Apr. 26, 2017 in South Africa, and which applications are incorporated herein by reference. To the extent appropriate, a claim of priority is made to each of the above disclosed applications.

FIELD OF INVENTION

THIS INVENTION relates to print bar structures, and a printer apparatuses comprising said print bar structures, particularly print bar structures and printer apparatuses comprising print heads for printing on generally cylindrical objects such as hollow containers, and to methods of printing.

BACKGROUND TO THE INVENTION

Cylindrical containers, including those with axial tapers, are often provided with indicia on outer surfaces thereof for decorative and/or branding purposes. As an alternative to adhesively attaching a pre-printed label to such containers, it is not uncommon to use conventional inkjet printing technologies to print indicia directly onto an outer surface of containers in accordance with pre-programmed image data.

One conventional means of inkjet printing directly onto cylindrical containers, typically involves a multi-pass approach wherein a container is presented to one or more printer heads and two or more independent droplets are printed at each print location on an outer surface of the container. The container or the head is moved in an iterative fashion until the ink is applied to the outer surface of the container in accordance with a pre-programmed image file. However, it will be appreciated that one disadvantage of this system is that printing time is increased, and the shape of the container often makes it impractical to use this method on a commercial scale.

Another, alternative, approach is to employ a plurality of stations comprising suitable print heads applying different colours. In this approach, each colour is printed on the containers separately by indexing between stations which each lay down a different colour. However, the disadvantages of this are that the suitable equipment to achieve this approach increases (as does the cost) and it thus undesirably bulky, moreover, the print quality is often adversely affected by the movement of the container between the different colour stations.

It is therefore at least an object of the present invention to ameliorate the above-mentioned disadvantages.

SUMMARY OF THE INVENTION

According to a first aspect of the invention, there is provided a print bar structure for a printing apparatus for use in printing on an outer surface of an object comprising at least one cylindrical portion, wherein the print bar structure comprises:

a body defining a print zone for receipt of the object to be printed, wherein the print zone has a central axis; and a plurality of radially spaced attachment formations provided adjacent the print zone for attachment of a plurality of print heads, wherein the print heads are operatively disposed within the print zone to form an arch within the print zone to deposit fluid from a fluid source onto the object along a printing axis which is at least transverse to the central axis of the print zone.

The arch formed by the print heads may be understood to be an arrangement of print heads having operative free printing ends thereof disposed in the print zone in an arcuate fashion or curved fashion so as to follow an outline of the cylindrical and/or part cylindrical object. The free printing ends disperse fluid, in an electronically controlled fashion.

The print bar structure may comprise a plurality of print banks, wherein each print bank comprises attachment formations for one or more print heads.

The print banks may be radially spaced from each other about the central axis of the print zone. In other words, the print banks may be circumferentially spaced on an interior wall of the body defining the print zone.

Each print bank may extend longitudinally along an axis which is substantially parallel to the central axis of the print zone. The axis along which each print bank may extend may be obliquely oriented with respect to the central axis so that conical containers may be printed. Instead, or in addition, the arch formed by the operative free ends of the print heads may be obliquely oriented with respect to the central axis.

The attachment formations may comprise one or more slots, wherein operative free ends of the print heads are locatable in said slots.

The print bar structure may comprise mounting means for mounting the same to a suitable platform of a printing apparatus. In this way, the print heads attached to the print bar structure are attached in a fixed fashion which enables the same to maintain a set position.

The attachment formations of each print bank may be arranged in a staggered fashion along an axis parallel to the central axis. There may be a slight overlap between adjacent attachment formations.

Instead, or in addition, the attachment formations of each print bank are arranged in-line along an axis parallel to the central axis such that each print head in the print head flanks or shoulders an adjacent print head.

The print bar structure may be shaped and/or dimensioned to define the print zone to receive a cylindrical or slightly conical object, wherein a clearance is provided for between walls of the body defining the print zone and the object located in the print zone, in use. In particular, the clearance may be between the operative free ends of the printer heads and the object, in use.

The object may be a cylindrical or slightly conical container having a closed end and an opposite open end.

The print bar structure may defines a cylindrical and/or slightly conical print zone or tunnel in which the print heads are operatively disposed.

The print heads attached to the print bar structure may provide a part-cylindrical or part conical area, or in other words the arch, in the print zone.

The print bar structure may comprise a plurality of print heads operatively attached thereto.

According to a second aspect of the invention, there is provided a printing apparatus for printing on an outer surface of an object comprising at least one cylindrical portion, wherein the apparatus comprises:

a print bar structure as described herein;

a plurality of print heads attachable to the print bar structure and operatively disposed in the print zone, wherein the plurality of print heads are in flow communication with one or more fluid sources and are configured to controllably deposit fluid received from the one or more fluid sources onto an outer surface of the object, in accordance with suitable image data;

a curing device arranged in the print zone, wherein the curing device is configured to curing the fluid deposited on the object; and a displacement assembly operatively attachable to the object, wherein once the container is in the print zone, the displacement assembly is operable to rotate object about an axis substantially aligned with the central axis relative to the plurality of print heads in the print zone such that fluid is deposited onto the object during rotation of the object.

The displacement assembly may be configured to axially displace the object into and out of the print zone along an axis substantially aligned with the central axis.

The fluid may be ink, wherein the print heads are fluidly coupled to an ink source of a particular colour of ink in an electronically controlled fashion.

The suitable image data may be a pre-determined image file corresponding to an image to be printed on the outer surface of the object.

The curing device may be configured to radiate energy to cure the ink. The curing device may be an ultraviolet (UV) curing device or heating device, extending along an axis parallel to the central axis. The curing device may be located opposite the print heads and oriented to radiate energy at least along an axis transverse to the central axis.

The displacement assembly may comprise a mandrel attachable to the object at a free end thereof and to a rotatable member at an opposite end thereof.

The mandrel may be bi-directionally displaceable along a path substantially aligned with the central axis so as to introduce and withdraw the object to and from the print zone, and rotatable about an axis substantially aligned with the central axis.

The displacement assembly may comprise a guide track to which the mandrel is operatively connected via a suitable mounting member, wherein the guide track is located adjacent the print bar structure and extends along an axis substantially parallel to the central axis such that the mandrel travels along bi-directionally along a path aligned with the central axis via the guide track.

The mandrel may comprise a suction device configured to draw the object thereto and hold the same snugly.

The mandrel may be shaped and/or dimensioned to engage with a particular type of object.

The printing apparatus may comprise:

a memory device storing data, including image data corresponding to an image to be printed onto the object; and one or more processors configured to:

control the displacement of the mandrel into the print zone;

control rotation of the mandrel relative to the print heads; and control the print heads to deposit fluid onto the object.

The processor may be configured to rotate the mandrel with an object operatively attached thereto, and control the print heads to deposit fluid onto the object in a simultaneous fashion such that a substantially single complete rotation prints the image corresponding to the image data onto the object.

The processor may be configured to operate the curing device to cure the deposited fluid. The processor may further be configured to control the mandrel to rotate the object to facilitate curing simultaneously and/or after printing.

The printing apparatus may comprise a suitable encoder to obtain data indicative of the rotation of the mandrel relative to the print bar/print heads, which data is communicated to the processor to control at least the speed of rotation of the mandrel and the print heads to deposit fluid.

The processor may be configured to adjust the density of the fluid deposited by the print heads onto the object.

According to a third aspect of the invention, there is provided a method of printing on an outer surface of an object comprising at least one cylindrical portion, wherein the method comprises:

providing a printing apparatus as described herein;

attaching the object to the displacement arrangement;

bringing the object and print zone into alignment;

rotating the object along the central axis whilst depositing fluid onto the outer surface of the object in accordance with image data corresponding to the image to be printed onto the object;

curing the fluid on the object by way of the curing device;

displacing the object, by way of the displacement arrangement, in a second direction opposite to the first direction; and releasing the object from the displacement arrangement.

The method may comprise displacing the object, by way of the displacement arrangement, along a path aligned with the central axis in a first direction into the print zone.

According to a fourth aspect of the invention, there is provided a print bar structure for a printing apparatus for use in printing on an outer surface of an object comprising at least one cylindrical portion, wherein the print bar structure comprises:

a body defining a cylindrical or cylindrical with a slight axially tapered print zone or tunnel for receipt of the object to be printed, wherein the print zone has a central axis; and a plurality of radially spaced attachment formations provided adjacent the print zone for attachment of a plurality of print heads such that the print heads are operatively disposed in the print zone, in use.

According to a fifth aspect of the invention, there is provided a manufacturing facility for manufacturing containers of the type having at least one cylindrical portion and indicia printed on an outer surface thereof, the facility comprising:

a container moulding assembly; and a printing apparatus as described herein located adjacent the container moulding assembly, wherein the printing apparatus receives freshly moulded containers from the container moulding assembly, and wherein the printing apparatus is configured to print on an outer surface of said container.

The container moulding assembly may be in the form of an injection moulding assembly. Thus is follow that the printing apparatus receives the freshly moulded containers prior to cooling of the same.

According to a sixth aspect of the invention, there is provided a method of manufacturing containers of the type having at least one cylindrical portion and indicia printed on an outer surface thereof, the method comprising:

providing a container moulding assembly;

locating a printing apparatus as described herein adjacent the container moulding assembly;

operating the container moulding assembly in a conventional fashion to produce a container;

presenting the freshly produced container to the printing apparatus before the container has completely cooled; and operating the printing apparatus in the fashion described above to print on the container.

DETAILED DESCRIPTION OF THE DRAWINGS

Figure 1:
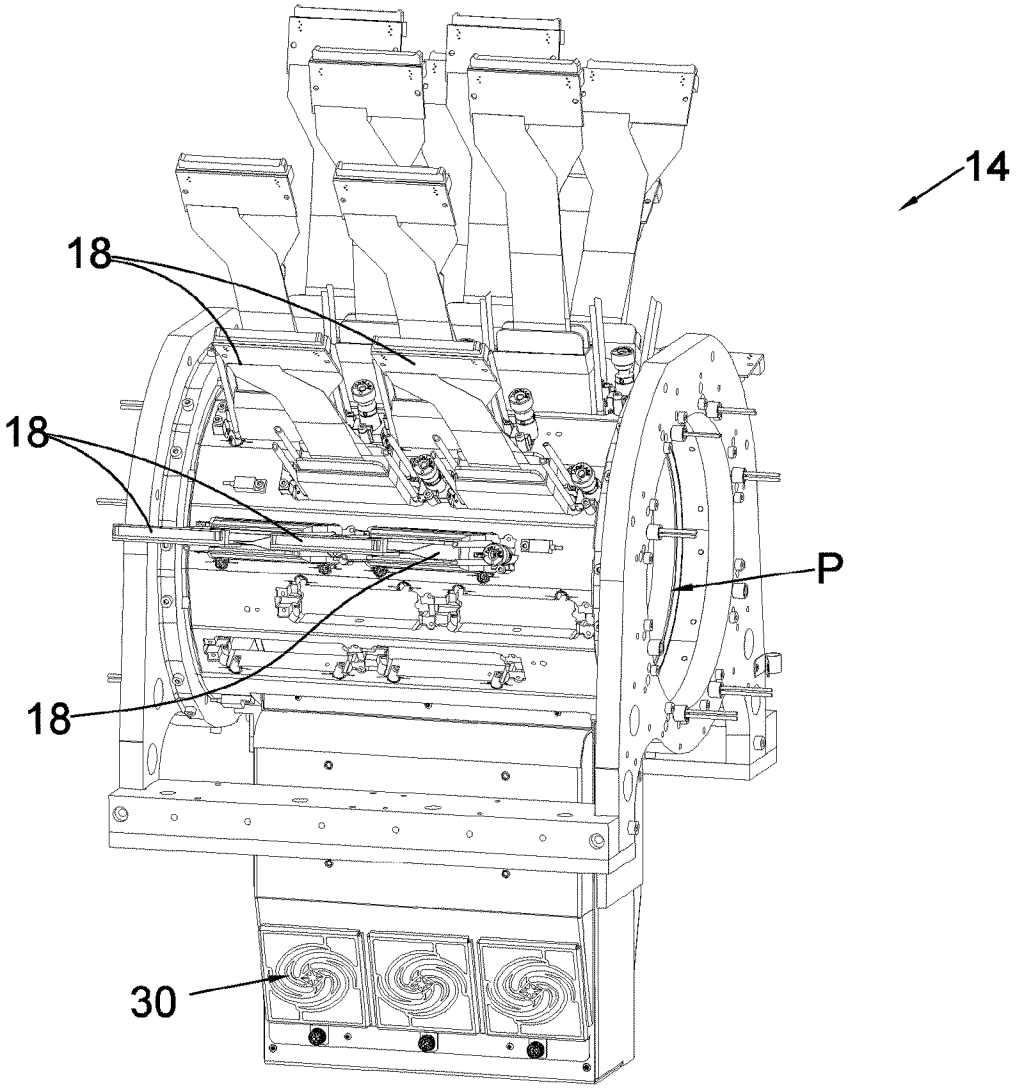
FIG. 1 shows perspective view of a print bar structure for a printing apparatus in accordance with an example embodiment of the invention.

The following description of the invention is provided as an enabling teaching of the invention. Those skilled in the relevant art will recognise that many changes can be made to the embodiment described, while still attaining the beneficial results of the present invention. It will also be apparent that some of the desired benefits of the present invention can be attained by selecting some of the features of the present invention without utilising other features. Accordingly, those skilled in the art will recognise that modifications and adaptations to the present invention are possible and can even be desirable in certain circumstances, and are a part of the present invention. Thus, the following description is provided as illustrative of the principles of the present invention and not a limitation thereof.

Referring generally to FIGS. 1 to 6, and FIGS. 11 to 16 of the drawings, a print bar structure for use in a printing apparatus 10 (as illustrated in FIGS. 13 to 16) configured for printing on an outer surface of an object 12 comprising at least one cylindrical portion is generally indicated by reference numeral 14.

In the present example embodiment, the object 12 is in the form of a hollow cylindrical container, for example, those injection moulded from a plastic material. It will be appreciated that though reference is made to a cylindrical object, the term "cylindrical", is meant to also include cylindrical objects which comprise an axial taper along a longitudinal axis thereof. In other words, objects which equally spaced points provided radially about a central axis thereof.

Figure 2:
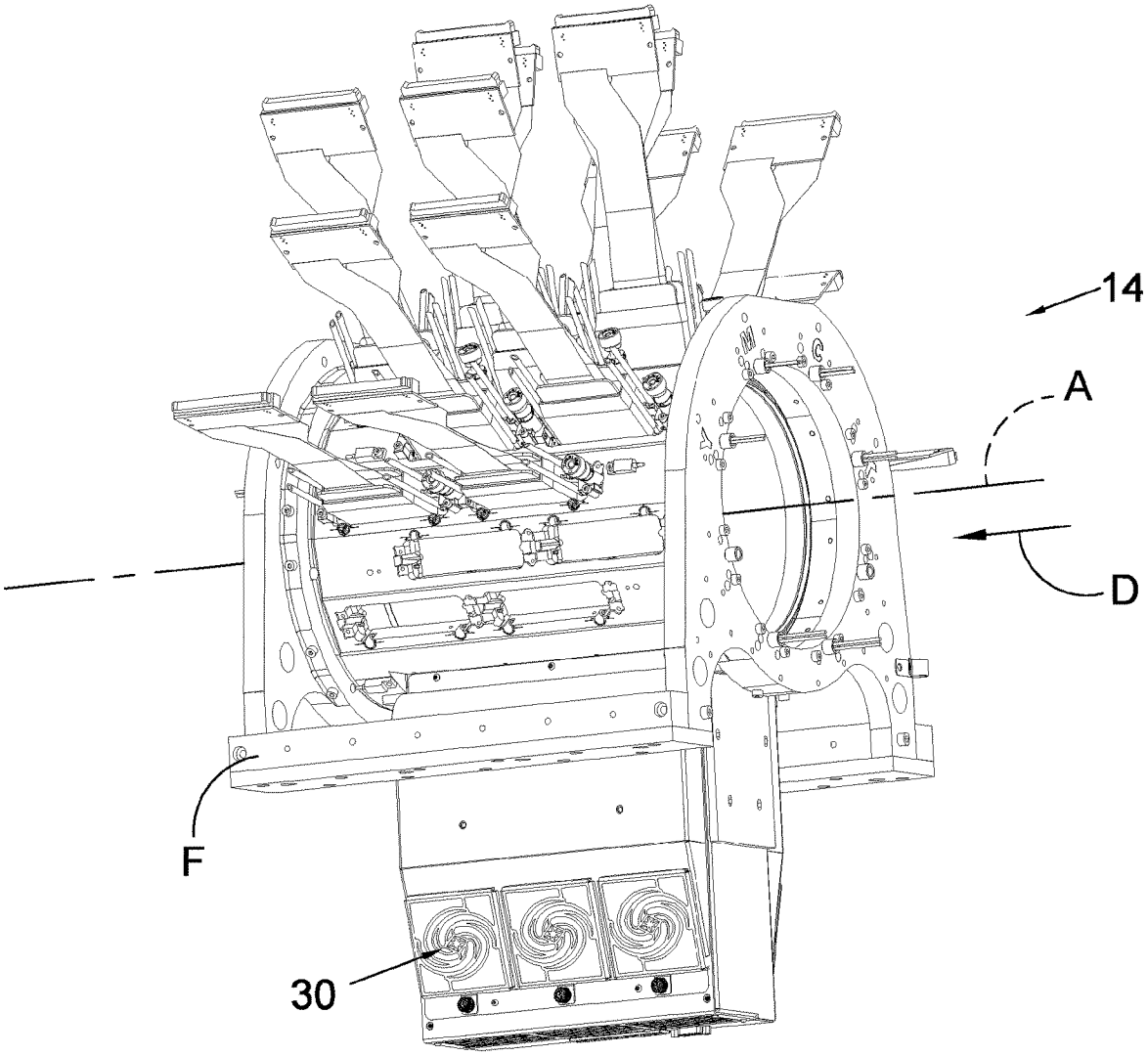
FIG. 2 shows another perspective view of a print bar structure for a printing apparatus in accordance with an example embodiment of the invention.
Figure 3:
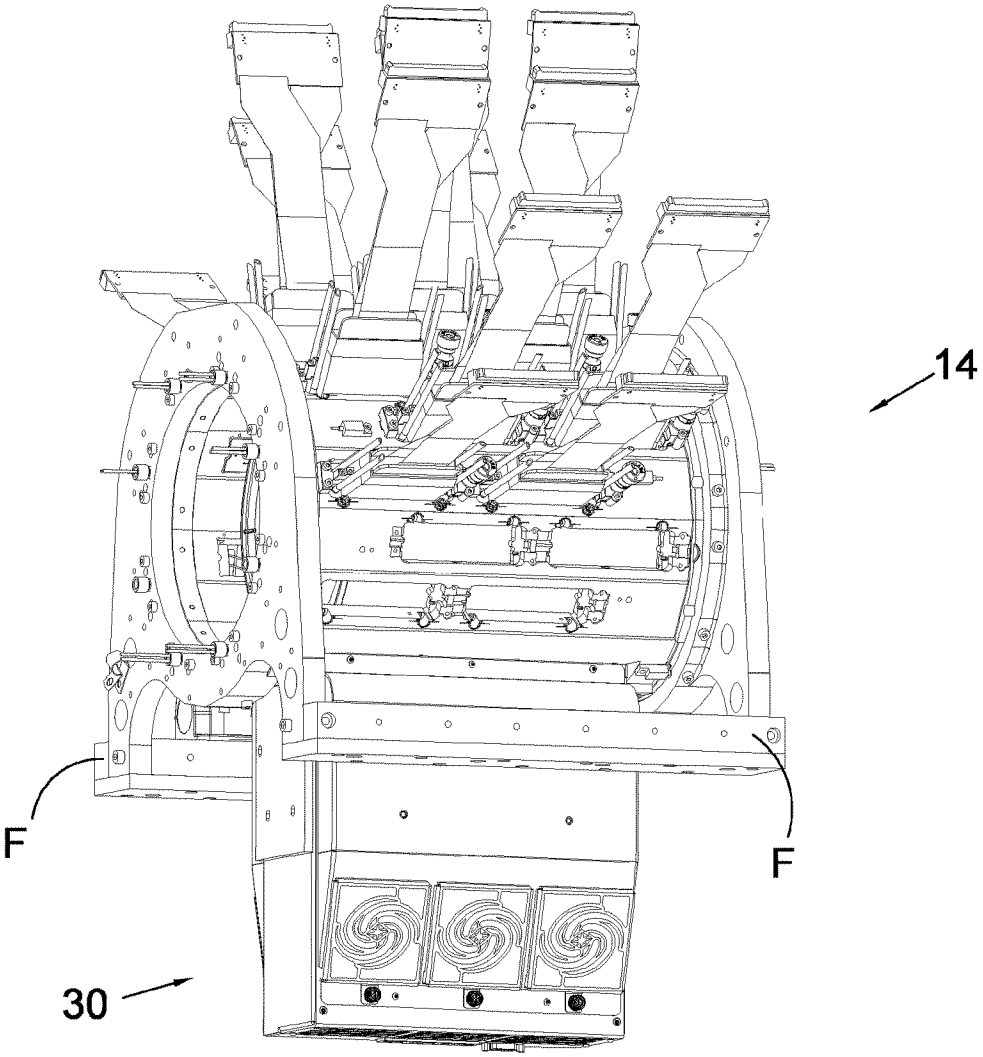
FIG. 3 shows another perspective view of a print bar structure for a printing apparatus in accordance with an example embodiment of the invention.
Figure 4:
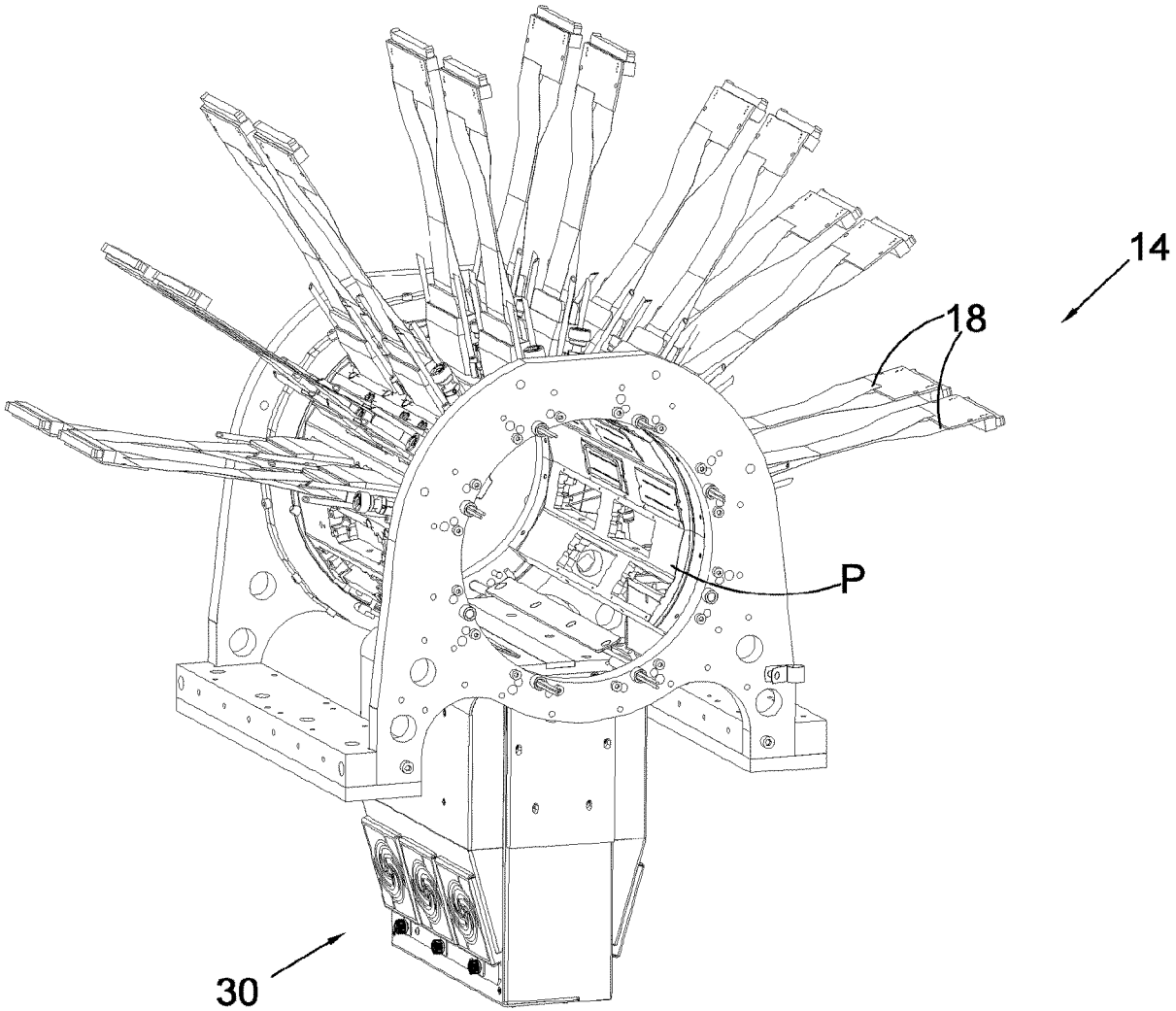
FIG. 4 shows another perspective view of a print bar structure for a printing apparatus in accordance with an example embodiment of the invention.
Figure 5:
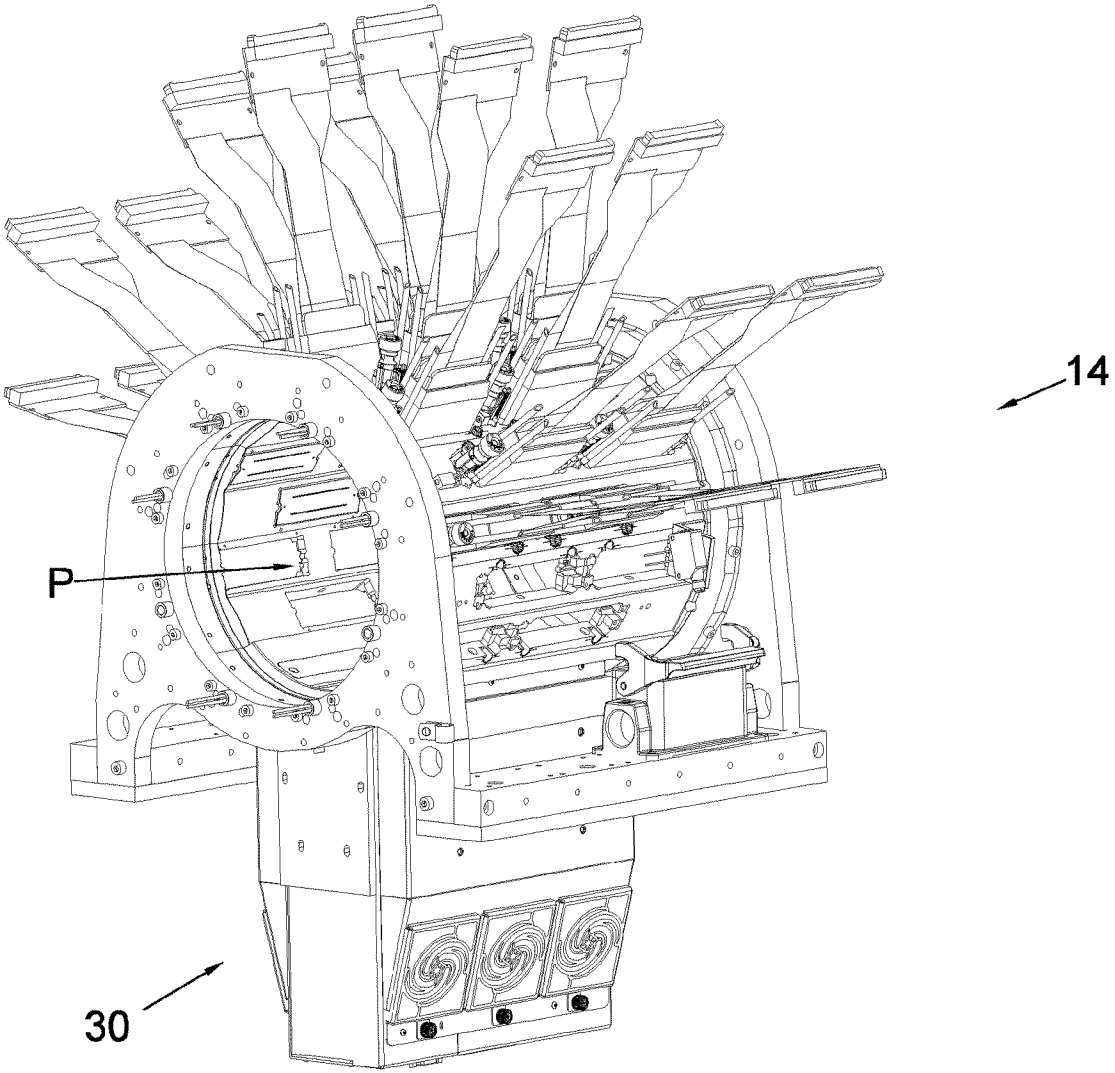
FIG. 5 shows another perspective view of a print bar structure for a printing apparatus in accordance with an example embodiment of the invention.
Figure 6:
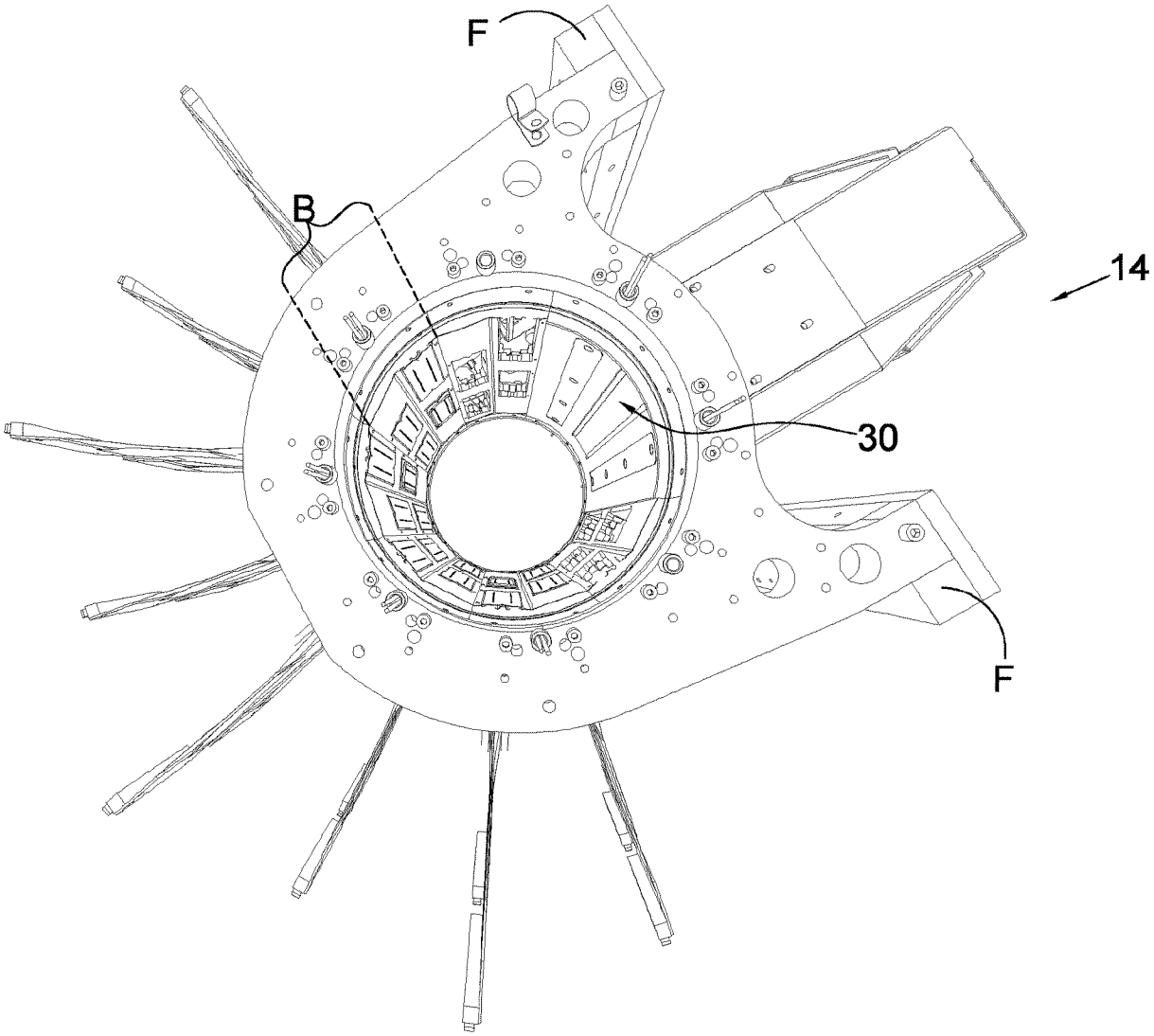
FIG. 6 shows another perspective view of a print bar structure for a printing apparatus in accordance with an example embodiment of the invention.
Figure 7:
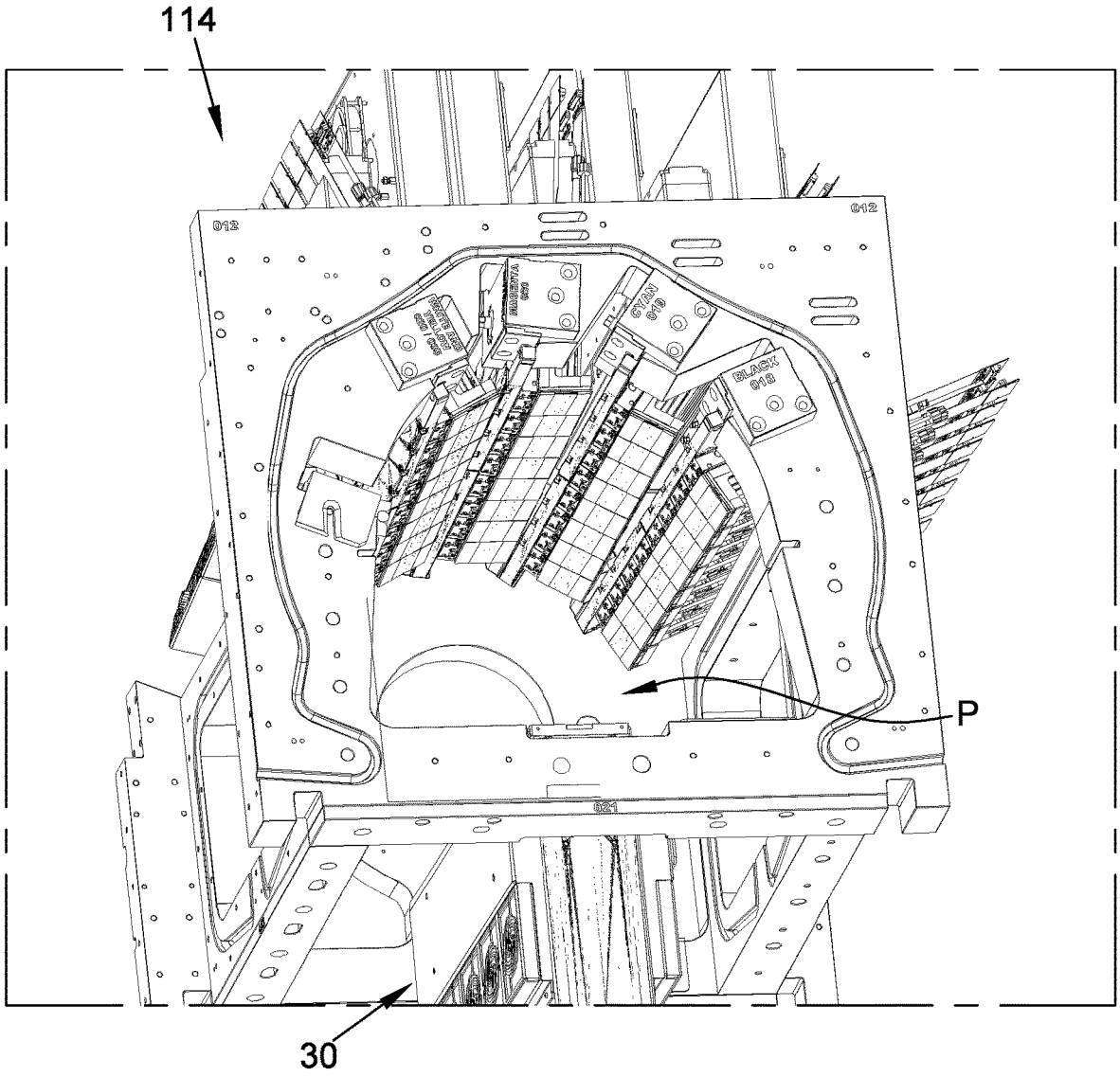
FIG. 7 shows a perspective view of another print bar structure in accordance with an example embodiment of the invention.
Figure 8:
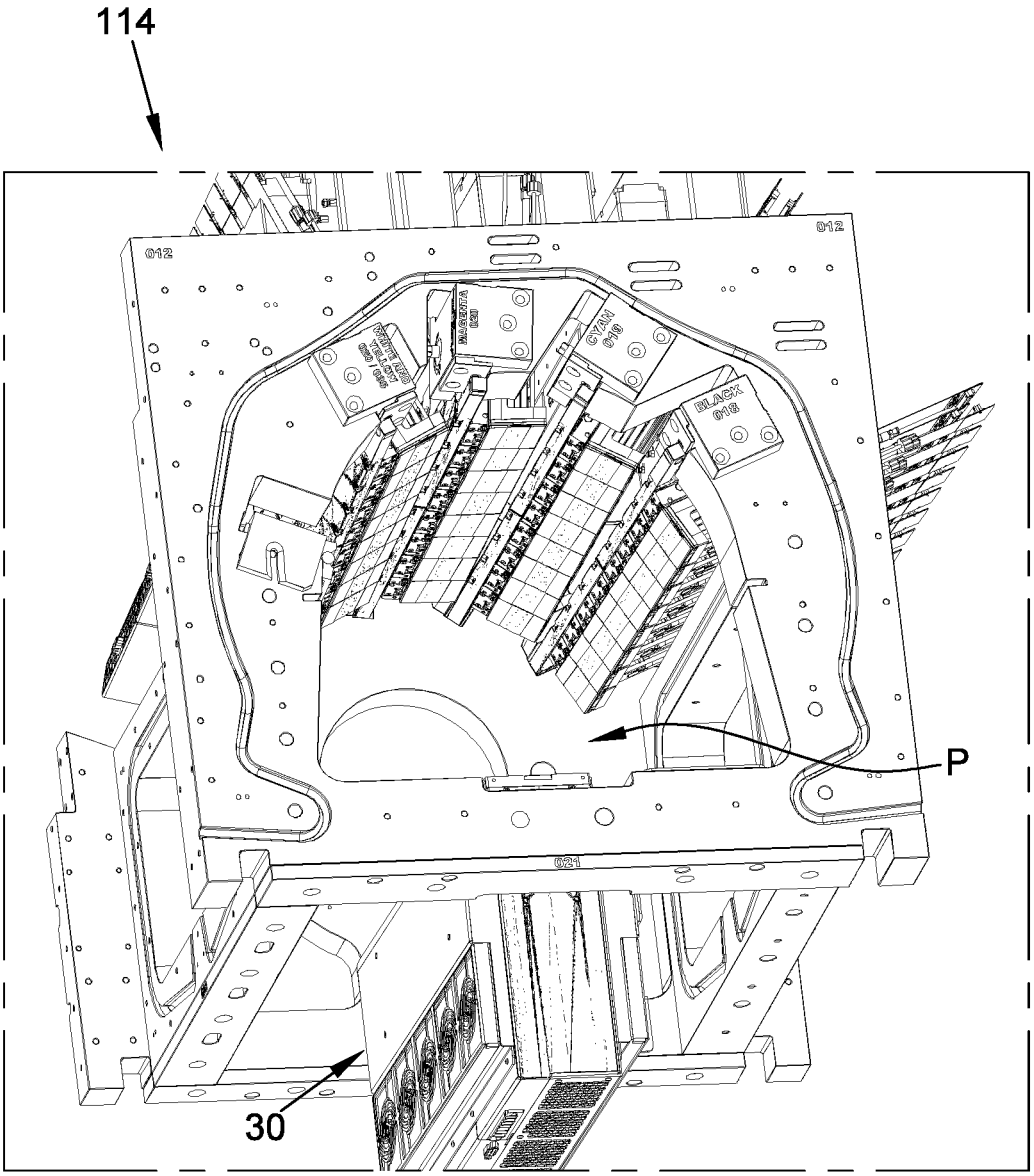
FIG. 8 shows another perspective view of another print bar structure in accordance with an example embodiment of the invention.
Figure 9:
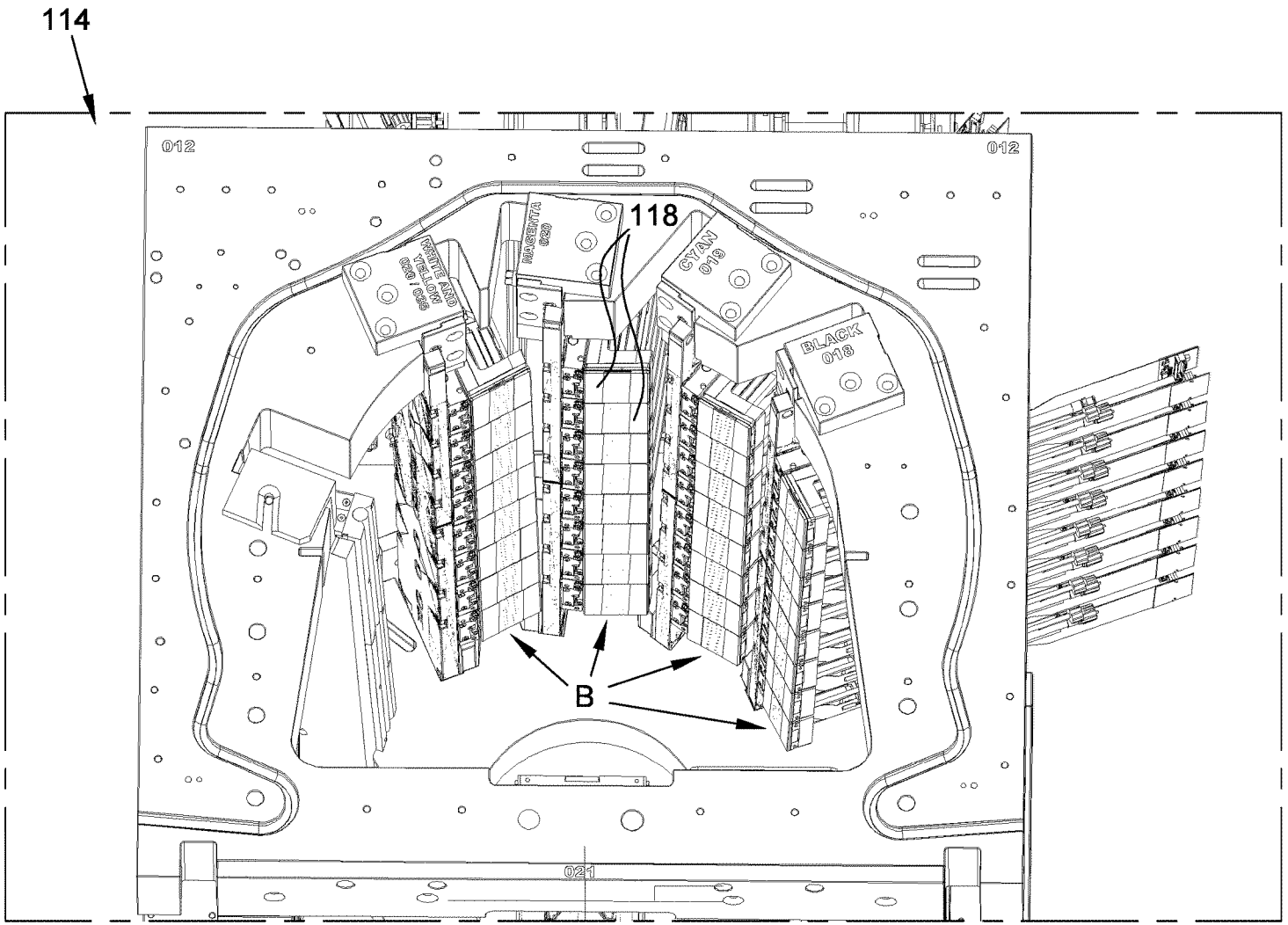
FIG. 9 shows a front elevation view of a portion of the print bar structure of FIGS. 7 and 8.
Figure 10:
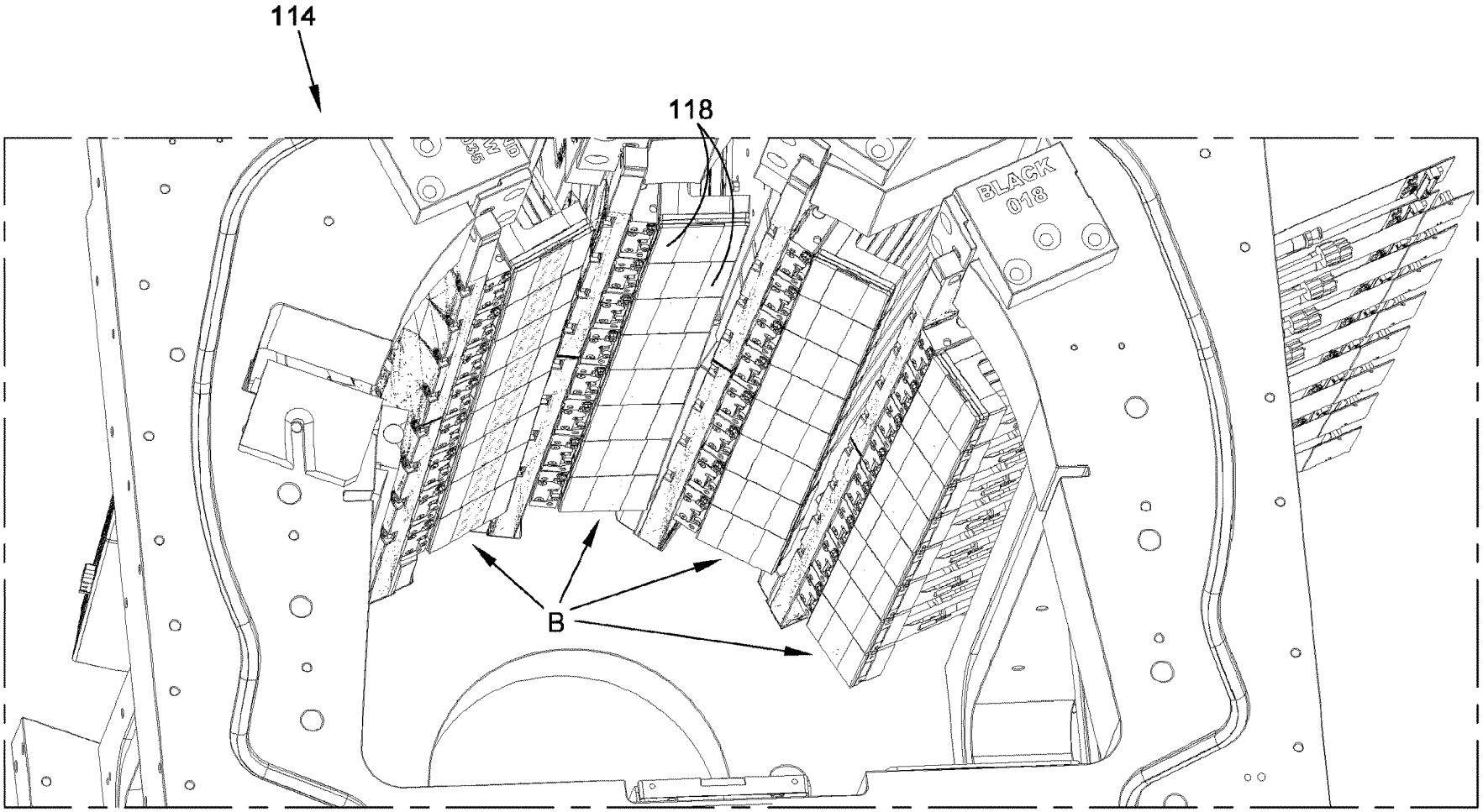
FIG. 10 shows another front elevation view of a portion of the print bar structure of FIGS. 7 and 8.
Figure 11:
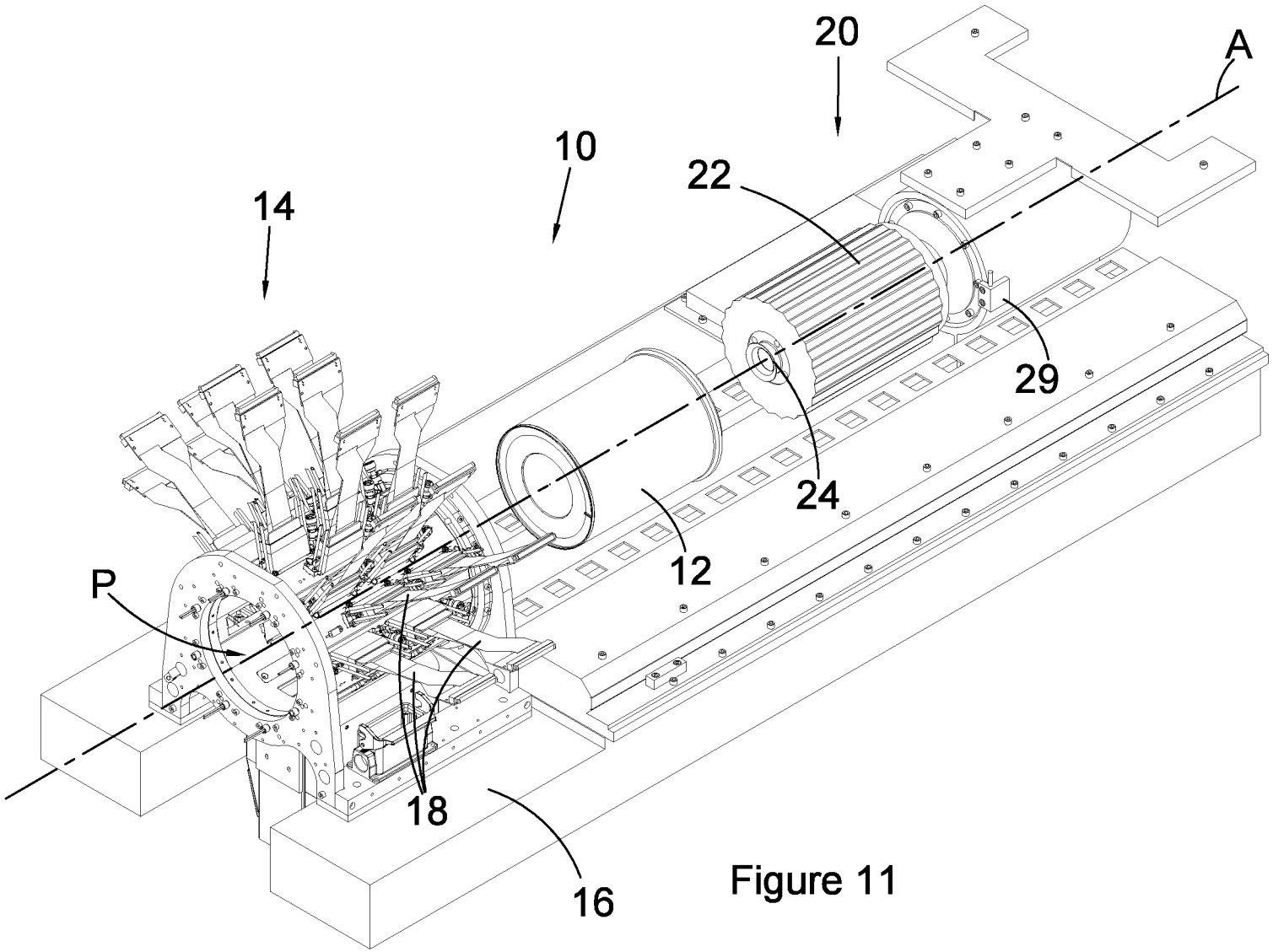
FIG. 11 shows a perspective view of a printing apparatus comprising the print bar structure of FIGS. 1 to 6.

The print bar structure 14 is configured to define a tunnel-like print zone P for receiving the object 12 axially therein along a central axis A in the direction of arrow D (see FIGS. 1 and 2). It will be appreciated that the print zone P is defined by an interior wall of the print bar structure 14. The structure may be a frame-like construction which is constructed of metallic material, including metallic alloys, composites, etc. However, in some example embodiments, all or some of the parts may be constructed from non-metallic substances.

The print bar structure 14 may be shaped and/or dimensioned to be spaced from, at a predetermined operative distance, the outer surface of the container 12 when the container 12 is located in the print zone P, as will be described below. It follows that print zone P may thus be cylindrical, as described herein, for axial receipt of a particular type of container 12. However, it will be noted that in some example embodiments, the print zone P may be part-cylindrical as will be discussed below.

The print bar structure 14 may be of a unitary construction. However, in some example embodiments, may be constructed from various interconnected parts.

For illustrative purposes, a plurality of print heads 18 illustrated to be attached to the print bar structure 14. The plurality of print heads 18 are disposed within the print zone P so as to in operative communication with, or in other words at a predetermined operative distance from, the outer surface of the object six object 12, in use, as will be described below. To this end, the print bar structure 14 may comprise suitable apertures and mounting formations for receipt and attachment of the print heads 18 such that they are operatively located within the print zone P. As illustrated, the print heads, particularly tail portions thereof, extend radially outwardly from the print bar structure 14. In this regard, it will be appreciated that the print bar structure 14 may form a hub defining the cylindrical zone P to which the print heads 18 are radially attachable such that their operative ends are disposed in an interior of the cylindrical zone defining the hub. In this way, a printing axis of each print head 18 is inwardly oriented into the print zone P. In particular, the printing axis of each print head 18 is substantially transverse to the central axis A.

The print heads 18 may be conventional electronically controlled print heads which are in flow communication with one or more fluids sources, for example, ink to be distributed or deposited thereby on the outer surface of the container 12, in use, in accordance with suitable image data or an image file. Though not illustrated, it will be noted that the print heads 18 are connected via suitable ducting or tubing to ink sources in the form of ink holding receptacles.

Also, not illustrated, it will be noted that the print heads 18 may be in electronic communication with, or comprise suitable one or more processors, memory device/s, suitable circuitry, and the like to control operation of the print heads 18 as well as the apparatus 10 as will be described below. Also, not shown, the apparatus 10 is powered by a suitable electrical power source. In this regard, the image file to be printed on the outer surface of the container 12 may thus be stored in the memory device/s and the one or more processors may be operable to control the print heads 18 to print in a per-programmed fashion in accordance with suitable computer program code stored in the memory device and/or processor.

Figure 12:
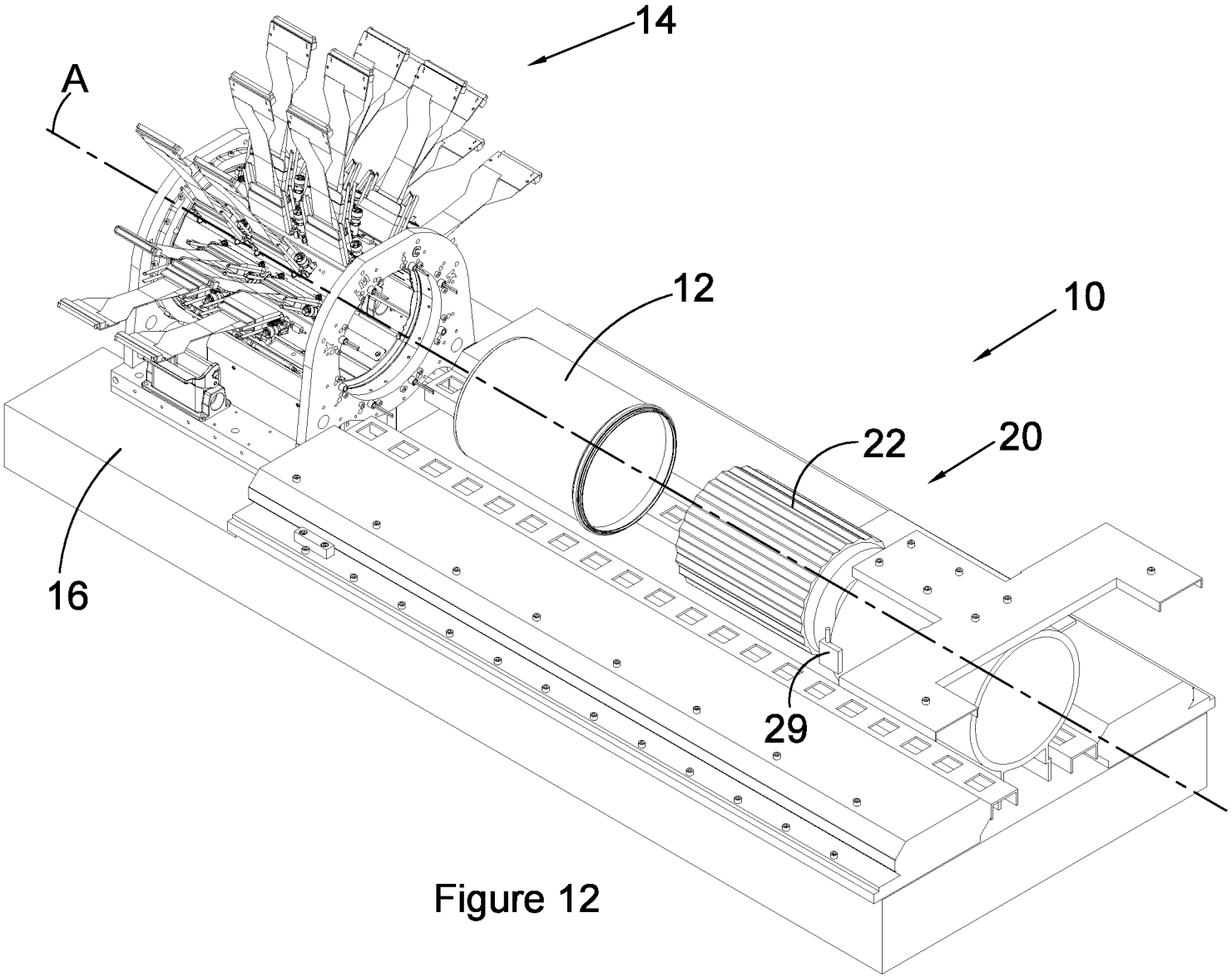
FIG. 12 shows another perspective view of a printing apparatus comprising the print bar structure of FIGS. 1 to 6.
Figure 13:
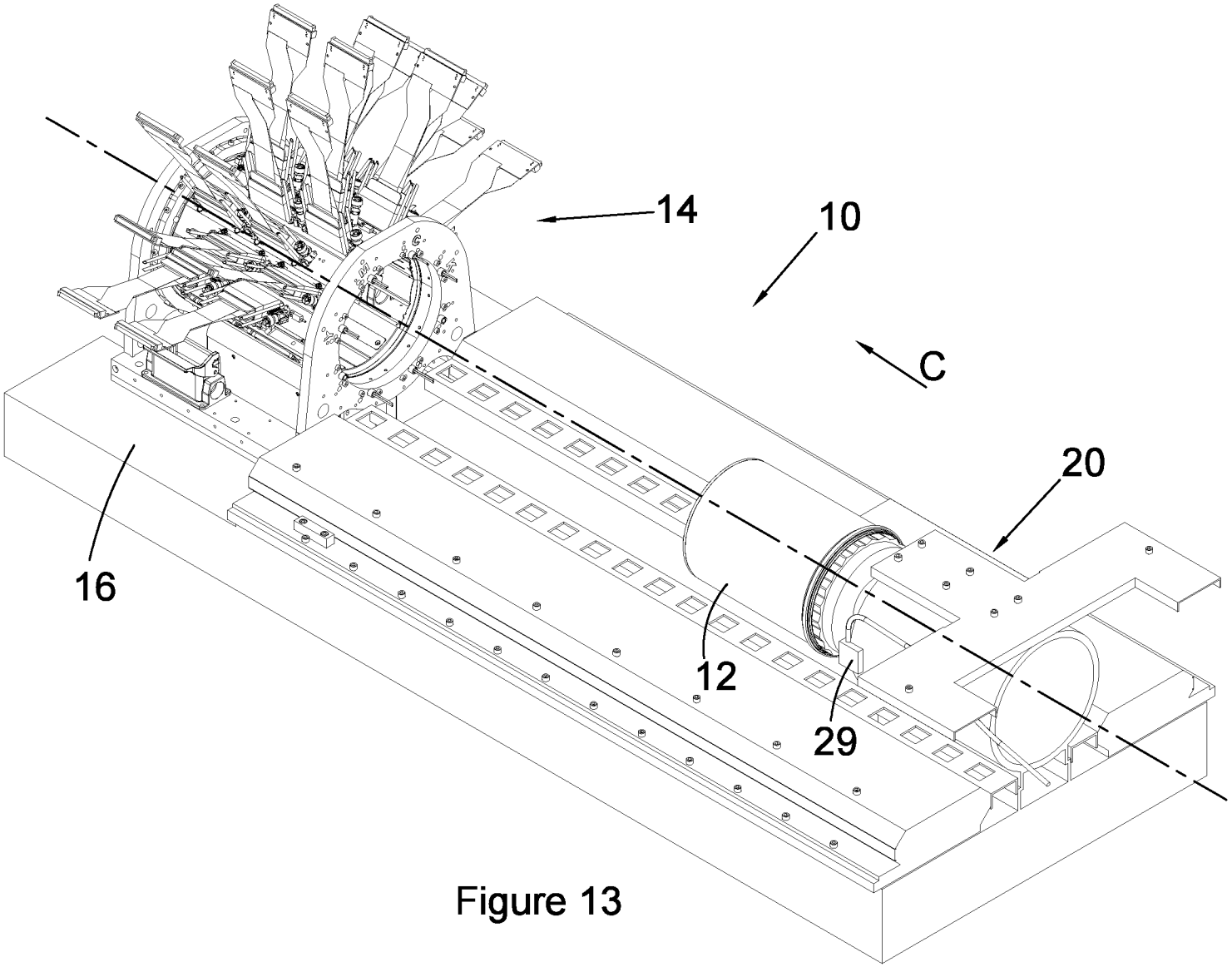
FIG. 13 shows perspective view of a printing apparatus in accordance with an example embodiment of the invention in engagement with an object to be printed, in a first operative condition.
Figure 14:
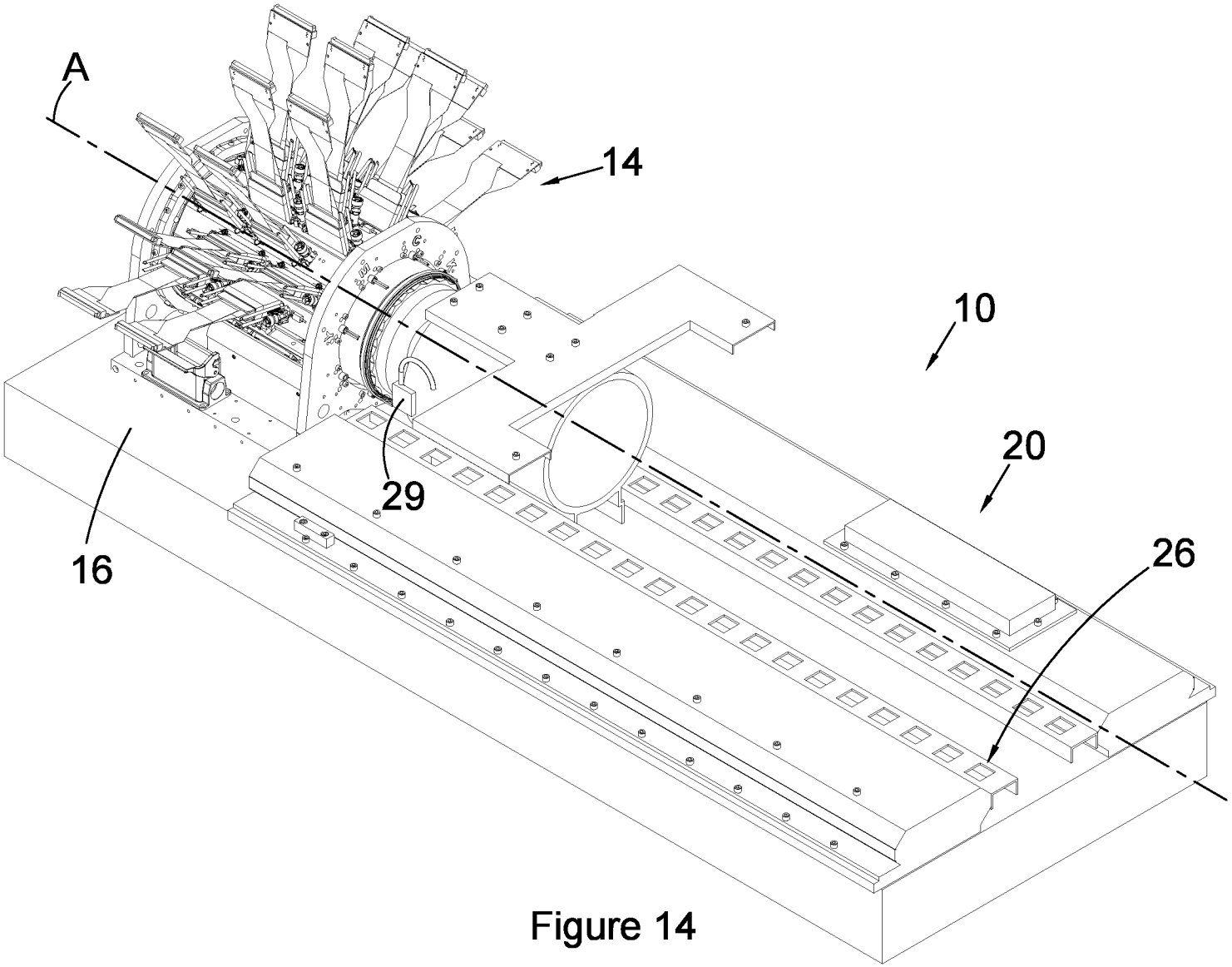
FIG. 14 shows perspective view of a printing apparatus in accordance with an example embodiment of the invention in engagement with an object to be printed, in a second operative condition.
Figure 15:
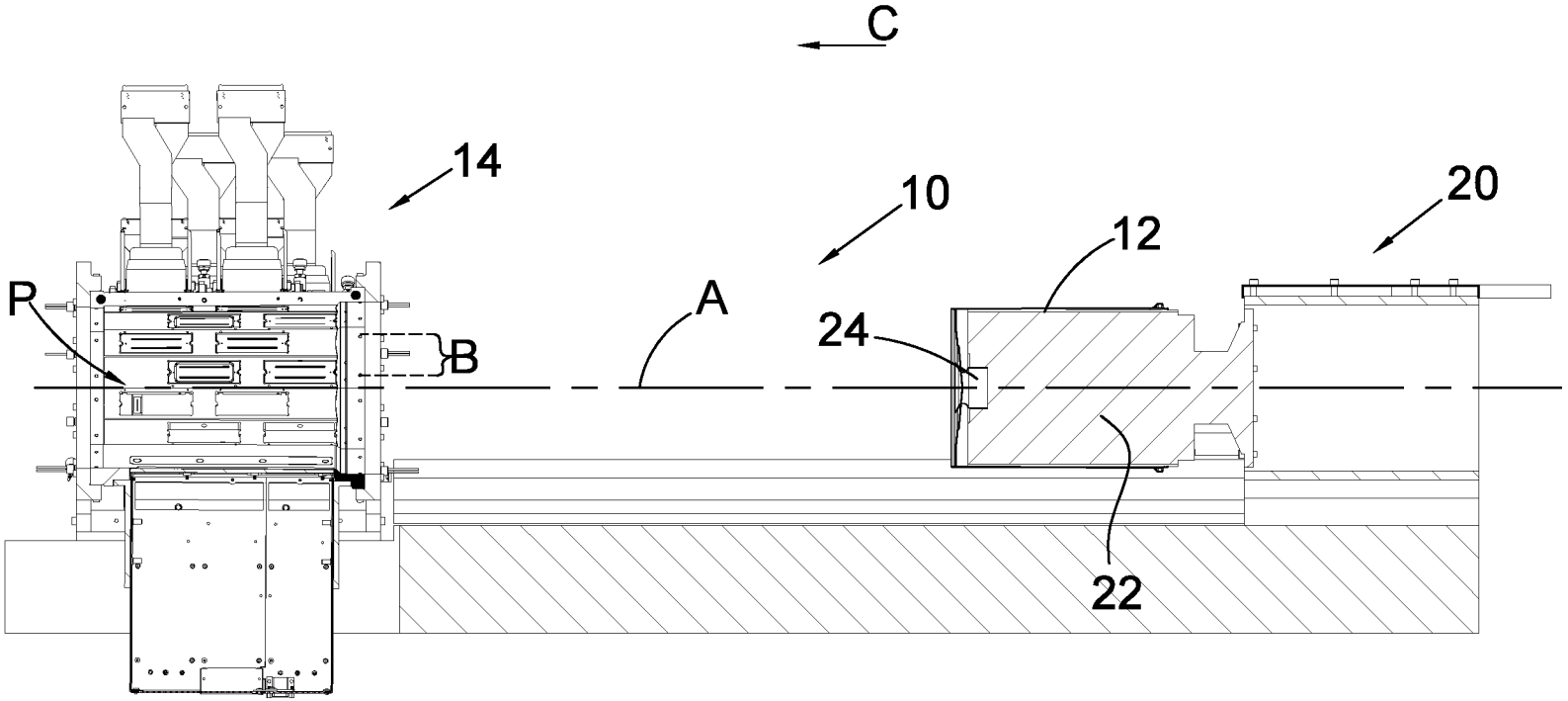
FIG. 15 shows a schematic sectional view of a printing apparatus in accordance with an example embodiment of the invention in engagement with an object to be printed, in a first operative condition.
Figure 16:
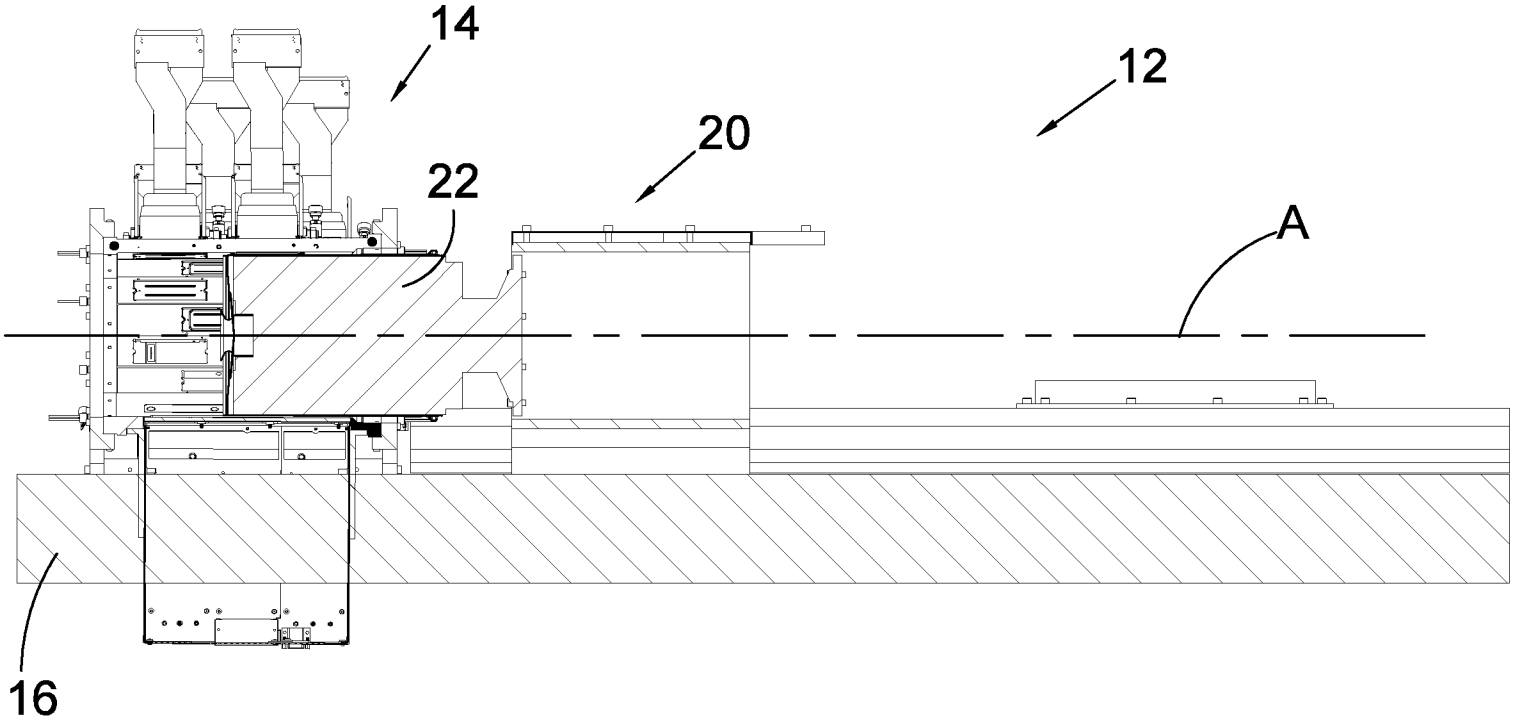
FIG. 16 shows a schematic sectional view of a printing apparatus in accordance with an example embodiment of the invention in engagement with an object to be printed, in towards second operative condition.

In one example embodiment, the print bar structure 14 is configured to provide groups of print heads 18 in banks B operatively within the print zone P, as can be seen more clearly from FIG. 12, by providing suitable attachment apertures or slots therefor. Each bank B is typically radially spaced relative to each other in the print zone P. Further, each bank B with the associated print heads 18 extends longitudinally within the print zone P along an axis parallel to the central axis A. Moreover, each bank B may be operatively connected to a different colour to be printed on the container 12.

In the illustrated example embodiment, the print heads 18 of the print head arrays provided in each print bank B are typically arranged in two rows and are provided in a staggered relationship relative to each other. However, there may be an overlap between adjacent print heads 18. The print heads 18 in each bank B extend longitudinally such that the depositing of ink by each print head 18 is parallel to the central axis A. It will be understood by those skilled in the field of invention will understand that the reference to the placement of the print heads 18 extends correspondingly to the suitable placement of the slots therefore in the structure 14 as the case may be.

In any case, by providing these print banks in a staggered, overlapping fashion, there is no discontinuation of the colours being applied to the objects outer surfaces of the containers 12. Though the illustrated example embodiment comprises four banks B of four print heads 18 each, it will be appreciated that the number of banks B depends on the number of colours are to be applied to the container 12 and may thus vary. Moreover, the number of print heads 18 per bank B will depend on the size of the container 12 and may thus also vary in terms of the number of rows and number of print heads 18 per row which extend longitudinally.

It will be appreciated that in having the print bar structure 14 manufactured to provide a print zone P with a continuous or closed structure the same shape and/or dimensions as the container 12, or at least a portion of the outline of the container 12, with an offset to allow for a gap between the inkjet print heads 18 and the outer surface of the container 12, is that it is very geometrically stable and each print head 18 maintains its position very accurately allowing for increased print quality. The gap between print heads 18 and the printing substrate is a major contributing factor in print quality. If this gap is increased there is a decrease on print quality.

The structure 14 may further comprise suitable mounting flanges F comprising suitable apertures for fixedly mounting the structure 14 to a support surface or frame such that is does not move.

In assembly, the plurality of print heads 18 are operatively connected to the print bar structure 14 in a radial fashion as illustrated and are mounted to the suitable slots such that their operative heads are located in the zone P. This may be before or after the flanges F are mounted by suitable screws, bolts or the like to a suitable support frame 16 in a fixed fashion as illustrated in FIGS. 11 to 16.

The structure 14 may in one example embodiment comprise a suitable slot for the attachment of a curing device 30 so as to be disposed operatively within the print zone P so as to control the curing of the ink deposited distributed onto the container 12. The curing device 30 may be a conventional ultraviolet (UV) curing device, a heating curing device, and the like configured to cure the ink as it is applied to the container 12.

Referring now to FIGS. 7 to 10 of the drawings where another example embodiment of a print bar structure for use with the printing apparatus 10 is generally indicated by reference numeral 114. The print heads structure 114 is substantially similar to the print bar structure 14 as described above and as such same or similar parts will be referred to by the same reference numerals.

The print head structure 114 differs from the structure 14 in that the print banks B in the structure 114 are comprised of an array of print heads 118 which are in-line and extend longitudinally as opposed to being provided in a staggered fashion as in the structure 14. In other words, the print heads 118 of the each print bank B in the print head structure 114 shoulder or flank each other. The spacing of the print heads 118 are such that they abut neighboring print heads 118 so as to ensure that there are no gaps in printing between the heads.

The print heads 118, like the print heads 18, have free print ends and printing axes which are substantially transverse to the central axis A through the print zone P. In other words, each of the print heads 118 operatively disperse fluid along printing axis which is transverse to the central axis A through the print zone P. Moreover, it will be noted that the print heads 118 are provided in an arch within the print zone P so as to define part of the print zone P in the structure 114 part-cylindrical or part-conical. It will be noted that in respect to the latter, the arch defined by the print heads 118 may extend longitudinally through the print zone along an axis which is slightly obliquely oriented with respect to the central axis A. In cases where right cylindrical objects are to be printed the print heads 118 extend along an axis substantially parallel to the central axis. Notwithstanding, it will be noted that the structures 14, 114 provide the print heads 18, 118 is in substantially close proximity to the object to be printed with a small clearance therebetween so as to enhance print quality.

In one example embodiment, the structure 114 comprises four print banks B, each bank comprising eight print heads shouldering or flanking each other. Though the illustrated example embodiment the structure 114 comprising four banks B of eight print heads 118 each, it will be appreciated that the number of banks B depends on the number of colours are to be applied to the container 12 and may thus vary. Moreover, the number of print heads 118 per bank B will depend on the size of the container 12 to be printed on and may thus also vary in terms of the number of rows and number of print heads 118 per row which extend longitudinally.

Each print bank is radially spaced with respect to the central axis. In other words, each print banks B is circumferentially spaced within the print zone P.

Referring now particularly to FIGS. 11 to 16 of the drawings where the printer apparatus for printing on an outer surface of a cylindrical object such as a container is illustrated. It will be appreciated that the apparatus 10 may comprise the print head structure 14 or the print head structure 114. As the principal of operation of the apparatus 10 with the structures 14 and 114 is substantially similar, only print head structure 14 is illustrated and discussed with reference to FIGS. 11 to 16. However, it will be evident to those skilled in the art that the description which follows will be applicable to both print head structures 14 and 114.

In any event, the printing apparatus 10 comprises of a displacement assembly 20 which is arranged on the frame 16 adjacent the print bar structure 14. The displacement assembly 20 is configured to be attachable to the object 12 and configured to be displaceable between a first condition, or loading condition/position, (see FIGS. 13 and 15) to a second condition, or printing condition/position (see FIGS. 14 and 16) thereby to allow the container to be attachable thereto in the loading condition and brought into print zone P of the structure 14 on along an axis aligned with the central axis A in the printing condition. The assembly 20 is further configured to rotate the container 12 about its axis, also aligned with the central axis A, so that the outer surface of the container 12 comes into contact with each print bank B of the printed structure 14 once in the print zone B.

To this end, the displacement assembly 20 may comprise a suitable mandrel 22 which is axially locatable within the interior of the container 12 in a relatively snug fashion. The mandrel 22 may thus be shaped and/or dimensioned for location within a particular shape and/or dimension of the container 12. In one example embodiment, the mandrel 22 is shaped and/or dimensioned for attachment to a container 12 immediately after it has been injection moulded and is thus in a warmed and expanded condition. In this way, printing of the container 12 is achieved prior to cooling thereof as will be apparent below. Notwithstanding, the mandrel 22 may comprise a suitable suction arrangement 24 operable to draw and withdraw container 12 snugly thereto and facilitate removal thereof.

The mandrel 22 is drivable, by way of a suitable drive arrangement of the displacement assembly 20, in a bi-directional fashion along an axis aligned with the central axis A. In this way, a container 12 attached to the mandrel 22 may be displaced also between the first and second conditions. The drive arrangement may comprise a suitable track 24 and suitable drive mechanisms such as a sprocket or wheel attachable thereto and the mandrel 22 to be able to drive the same, typically with the container 12 attached, between first and second conditions. The drive arrangement may take on various forms, including manual, and automated to be able to displace the mandrel 22, for example, the drive arrangement may comprise a suitable drive belt and pulley arrangement, a chain and sprocket arrangement, a track and castor arrangement, and the like. However, what is important is that the drive arrangement is configured to steadily hold and drive the container 12 into the print zone P so as to maintain a pre-configured distance or gap between the print heads 18 disposed within the print zone P and the outer surface of the container 12, in use, during rotation of the container 12.

The displacement assembly is further configured to rotate the mandrel 22, and a container 12 attachable thereto, in use about an axis aligned with the central axis B, typically whilst the container 12 is located in the print zone P. The assembly 20 thus comprises suitable motors and associated circuitry (not shown), for example, stepper motor/s, suitable drive circuitry and a drive shaft operatively coupling the mandrel to the motor to carefully control rotation of the mandrel 22 and the container 12 in the print zone P.

The rotation of the mandrel 22 may be controlled by the processor to rotate the container 12 whilst the processor simultaneously controls the print heads 18 to deposit fluid onto the outer surface of the container 12 in a fashion which enables substantially a single rotation of the container about its axis aligned with the central axis A to entirely coat the container 12 with ink in accordance with a pre-determined image file. Moreover, for containers 12 that have slight axial tapers the print heads 18 may be controlled by the suitable processor to be reduce ink drop densities on a linear basis as between the top and bottom of the container 12. The apparatus 10 may also comprise an encoder 29 and associated circuitry (not shown) coupled to the mandrel 22, wherein the encoder 29 is configured to transmit data indicative of the rotation of the mandrel 22 and hence the container 22 to the processor which in term processes this data to control the rotation and/or the print heads 18 to deposit the ink onto the outer surface of the container 12.

The apparatus 10 further comprises a suitable curing device 30 arranged within the print zone P and attachable to the print bar structure so as to control the curing of the ink deposited distributed onto the container 12. The curing device 30 may be a conventional ultraviolet (UV) curing device, a heating curing device, and the like configured to cure the ink as it is applied to the container 12. It follows that in one example embodiment, the container 12 is rotated beyond a single complete revolution about its axis so as to facilitate the curing device 30 curing ink deposited thereon.

In use, referring to FIGS. 11 to 16 in particular, the printing apparatus 10 as described herein is typically installed with a low footprint adjacent an injection moulding machine (not shown) configured to mould containers 12 out of a plastic material. A freshly moulded container 12 is removed immediately from the injection moulding machine and, whilst still warm and uncontaminated, is operatively attached to the mandrel 22 whilst the displacement assembly 20 is in the first condition.

The suction arrangement 24 is operated to hold the container 12 to the mandrel. Suitable processing circuitry is then operated to operate the displacements assembly 20 to cause automated axial displacement of the mandrel 22 and container 12 mounted thereon in an axial direction along an axis aligned with the axis A in the direction of arrow C (see FIGS. 3 and 5) between the first condition and second condition along the track 26 in a generally conventional fashion using, for example a belt and pulley arrangements, a wheeled track arrangement, etc. until the container 12 is at a predetermined axial position inside the print zone P. Notwithstanding, it will be noted that in some example embodiments, the mandrel 22 may be manually operated by an operator manually urging the mandrel 22 with the container 12 attached thereto along the track 26 into the print zone P.

Once the container 12 is suitably located within the print zone P with all the print heads P at a close predetermined operative proximity and/or positions relative to the outer surface of the container, the processor controls the rotation of the mandrel 22 via suitable motor/s at a predetermined speed linked or coupled to the print heads 18 being controlled by the processor to simultaneously deposit respective colours of ink onto the outer surface of the container 12 in accordance with the predetermined image file. The speed of rotation of the container 12 is detected by a suitable encoder 29 for such purpose.

The curing device 30 is operated to assist in curing the ink on the outer surface of the container 12. Though all the ink is typically deposited in a single rotational pass of the container about an axis aligned with the central axis A, i.e., a 360° rotation, further rotation may occur for curing purposes.

Once all the print heads 18 have had an opportunity to deposit all their respective colours of ink on the surface of the container 12 in accordance with a suitable image file, the and the suitable curing has been completed by the curing device 30, the displacement assembly 20 is operated to withdraw the container 12 from location within the print zone P in a direction opposite to direction C to the loading condition. The suction device 24 is operated to allow for a release of the container 12, the outer surface of which is coated with ink corresponding to the image file.

It will be appreciated that the round/conical shaped print bar structure does not move and once the container is inside the print bar structure being printed on, there is only a rotational movement of the container. If the rotational movement is accurately controlled it allows the print heads to be much closer to the containers and hence improves the print quality.

Though whilst the apparatus is described with regards to the print bar structure 14 being fixedly mounted and the container rotated relative thereto. It will be noted that in some example embodiment, though less efficient, this may be vice versa, i.e., the container be fixed to a holding structure such as a mandrel, and the print bar structure may be moved to bring the container into the print zone and the print bar structure is rotated relative to the container to print on the same. Alternately, the container may be held in a particular position, and the print bar structure as described herein may move axially toward the container until the container is in the print zone, whereafter, the container is rotated in the fashion described above to print thereon. In this example embodiment, the displacement arrangement may be configured to move the print bar structure towards the container.

The invention as described herein provides a substantially single-pass multi-head direct-to-container means of printing on containers where all colours are laid down onto the container in substantially one revolution of the container.

The invention claimed is:

1. A print bar structure for a printing apparatus for use in printing on an outer surface of an object comprising at least one cylindrical portion, wherein the print bar structure comprises:

a body defining a print zone for receipt of the object to be printed, wherein the print zone has a central axis; and a plurality of radially spaced attachment formations provided adjacent the print zone for attachment of a plurality of print heads, wherein the print heads are operatively disposed within the print zone to form an arch within the print zone to deposit fluid from a fluid source onto the object along a printing axis which is at least transverse to the central axis of the print zone, wherein the print bar structure comprises a plurality of print banks, wherein each print bank comprises attachment formations for one or more print heads, and wherein each print bank extends along an axis which is obliquely oriented with respect to the central axis or wherein the arch defined by the print heads extends along an axis which is obliquely oriented with respect to the central axis.

2. A print bar structure as claimed in claim 1, wherein the print banks are radially spaced from each other about the central axis of the print zone.

3. A print bar structure as claimed in claim 1, wherein the print banks are circumferentially spaced on an interior wall of the body defining the print zone.

4. A print bar structure as claimed in claim 1, wherein the attachment formations comprise one or more slots, wherein free operative print ends of the print heads are locatable in said slots so as to form the arch within the print zone.

5. A print bar structure as claimed in claim 1, wherein the print bar structure comprises mounting means for mounting the same to a suitable platform of a printing apparatus.

6. A print bar structure as claimed in claim 1, wherein the attachment formations of each print bank are arranged in a staggered fashion along an axis parallel to the central axis.

7. A print bar structure as claimed in claim 1, wherein the attachment formations of each print bank are arranged in-line along an axis parallel to the central axis such that each print head in the print head flanks an adjacent print head.

8. A print bar structure as claimed in claim 1, wherein the print bar structure is shaped and/or dimensioned to define the print zone to receive a cylindrical or slightly conical object, wherein a clearance is provided for between walls of the print bar structure defining the print zone and the object located in the print zone, in use.

9. A print bar structure as claimed in claim 1, wherein the print bar structure comprises a plurality of print heads operatively attached thereto.

10. A printing apparatus for printing on an outer surface of an object comprising at least one cylindrical portion, wherein the apparatus comprises:

a print bar structure as claimed in claim 1;

a plurality of print heads attachable to the print bar structure and operatively disposed in the print zone, wherein the plurality of print heads are in flow communication with one or more fluid sources and are configured to controllably deposit fluid received from the one or more fluid sources onto an outer surface of the object, in accordance with suitable image data;

a curing device arranged in the print zone, wherein the curing device is configured to curing the fluid deposited on the object; and a displacement assembly operatively attachable to the object, wherein once the container is in the print zone, the displacement assembly is operable to rotate object about an axis substantially aligned with the central axis relative to the plurality of print heads in the print zone such that fluid is deposited onto the object during rotation of the object.

11. A printing apparatus as claimed in claim 10, wherein the displacement assembly is configured to axially displace the object into and out of the print zone along an axis substantially aligned with the central axis.

12. A printing apparatus as claimed in claim 10, wherein the fluid is ink, wherein the print heads are fluidly coupled to an ink source of a particular colour of ink in an electronically controlled fashion.

13. A printing apparatus as claimed in claim 10, wherein the curing device is configured to radiate energy to cure the ink, wherein the curing device is an ultraviolet (UV) curing device or heating device, extending along an axis parallel to the central axis.

14. A printing apparatus as claimed in claim 10, wherein the curing device is located opposite the print heads and oriented to radiate energy at least along an axis transverse to the central axis.

15. A printing apparatus as claimed in claim 10, wherein the displacement assembly comprises a mandrel attachable to the object at a free end thereof and to a rotatable member at an opposite end thereof, wherein the mandrel is bi-directionally displaceable along a path substantially aligned with the central axis so as to introduce and withdraw the object to and from the print zone, and rotatable about an axis substantially aligned with the central axis.

16. A printing apparatus as claimed in claim 15, wherein the displacement assembly comprises a guide track to which the mandrel is operatively connected via a suitable mounting member, wherein the guide track is located adjacent the print bar structure and extends along an axis substantially parallel to the central axis such that the mandrel travels along bi-directionally along a path aligned with the central axis via the guide track.

17. A printing apparatus as claimed in claim 15, wherein the printing apparatus comprises:

a memory device storing data, including image data corresponding to an image to be printed onto the object; and one or more processors configured to:

control the displacement of the mandrel into the print zone;

control rotation of the mandrel relative to the print heads; and control the print heads to deposit fluid onto the object.

18. A printing apparatus as claimed in claim 17, wherein the processor is configured to rotate the mandrel with an object operatively attached thereto, and control the print heads to deposit fluid onto the object in a simultaneous fashion such that a substantially single complete rotation prints the image corresponding to the image data onto the object.

19. A method of printing on an outer surface of an object comprising at least one cylindrical portion, wherein the method comprises:

providing a printing apparatus claimed in claim 10;

attaching the object to the displacement arrangement;

bringing the object and print zone into alignment;

rotating the object along the central axis whilst depositing fluid onto the outer surface of the object in accordance with image data corresponding to the image to be printed onto the object;

curing the fluid on the object by way of the curing device;

displacing the object, by way of the displacement arrangement, in a second direction opposite to the first direction; and releasing the object from the displacement arrangement.

20. A method as claimed in claim 19, wherein the method comprises displacing the object, by way of the displacement arrangement, along a path aligned with the central axis in a first direction into the print zone.

* * * * *